US006773278B2

(12) United States Patent
Valasek, Jr. et al.

(10) Patent No.: US 6,773,278 B2
(45) Date of Patent: Aug. 10, 2004

(54) ELECTRICAL CONNECTOR WITH MULTIPLE PLUG AND SHROUD COMPARTMENTS

(75) Inventors: Anthony Joseph Valasek, Jr., Warren, PA (US); James Edward Gundermann, Warren, PA (US); Glenn Richard Moore, Warren, PA (US); Matthew Bryan Hitchcock, Warren, PA (US); Roger A. Elmer, Sugar Grove, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/105,102

(22) Filed: Mar. 22, 2002

(65) Prior Publication Data

US 2003/0181084 A1 Sep. 25, 2003

(Under 37 CFR 1.47)

(51) Int. Cl.[7] ..... H01R 13/62

(52) U.S. Cl. ..... 439/157; 439/587; 439/540.1; 439/275

(58) Field of Search ..... 439/157, 587, 439/271, 274, 275, 279, 680, 540.1

(56) References Cited

U.S. PATENT DOCUMENTS

| | | | | | |
|---|---|---|---|---|---|
| 5,178,553 | A | * | 1/1993 | Hatagishi et al. | 439/157 |
| 5,320,544 | A | * | 6/1994 | Naoto et al. | 439/157 |
| 5,634,807 | A | * | 6/1997 | Saito | 439/275 |
| 6,030,235 | A | * | 2/2000 | Ittah et al. | 439/157 |
| 6,099,330 | A | * | 8/2000 | Gundermann et al. | 439/157 |
| 6,354,852 | B2 | * | 3/2002 | Noro et al. | 439/157 |
| 6,361,356 | B1 | * | 3/2002 | Heberlein et al. | 439/157 |
| 6,371,778 | B1 | * | 4/2002 | Watanabe | 439/157 |

* cited by examiner

*Primary Examiner*—Tho D. Ta

(57) ABSTRACT

An electrical connector system for use with an automobile power control module has been provided, which comprises a plurality of sealed plug assemblies and a header assembly. Each of the sealed plug assemblies includes a cam lever. The header assembly includes a plurality of shrouds for receiving the plurality of sealed plug assemblies. The plurality of shrouds corresponds to the plurality of sealed plug assemblies. Each of the sealed plug assemblies is mated into one of the plurality of shrouds through a movement of said cam lever.

25 Claims, 11 Drawing Sheets

ELECTRICAL CONNECTOR WITH MULTIPLE PLUG AND SHROUD COMPARTMENTS

BACKGROUND OF THE INVENTION

Certain embodiments of the present invention generally relate to a connector for electronic equipment, and more particularly to an electrical connector having multiple plug configurations for use with a power train control module of an automobile.

The mating of a plug assembly into a receptacle assembly, or a shroud, to form a connector assembly often involves a high insertion force. This is particularly true when the connector comprises mating connector housings containing many contacts. For example, automobile wiring systems, such as power train systems, typically include electrical connectors. Typically, each electrical connector includes a plug assembly and a header assembly. The plug assembly is mated into a shroud of the header assembly. The header assembly is in turn mounted on a printed circuit board.

Each electrical connector includes a large number of electrical contacts, which are electrically and mechanically connected to respective electrical wires in the electrical connector. One method of overcoming the high insertion force to connect the plug assembly into the shroud is to use a cam lever, which is positioned on a portion of the electrical connector, to provide the actuation force to mate the plug assembly into the shroud. U.S. Pat. No. 6,099,330 entitled "Connector With Lever," issued to Gundermann et al., discloses such a method.

While lever actuation provides a useful method of mating a plug assembly into a shroud, a drawback of the electrical connector having a large number of contacts is that even with cam lever actuation, only a certain number of contacts may be included within the electrical connector. Typically, cam lever actuation can only provide enough force for a limited number of electrical contacts. That is, as more electrical contacts are used within the electrical connector, more force is needed to mate the plug assembly into the shroud. Typically, there is a point at which the cam lever actuation cannot provide enough force to adequately mate the plug assembly with the shroud.

Today, many electrical connectors are able to house a large number of electrical contacts. Typically, however, these electrical connectors are bulky and often times cannot fit into small areas.

Additionally, when electrical contacts within the electrical connector fail, typically the entire electrical connector, or at least one of the plug assembly or shroud, needs to be replaced. If the electrical connector is found to be inadequate, inoperable or otherwise sub-optimal due to a few faulty contacts or connections (even though a large number of operable contacts and connections still exist within the electrical connector), discarding the electrical connector, or components of the electrical connector, is typically costly and inefficient. Even if the electrical connector can be salvaged through replacing individual contacts within the components, the process of inspecting the electrical connector and segregating the faulty contacts from the operable contacts is tedious and time consuming.

Thus a need exists for an improved electrical connector. Specifically, a need exists for an improved electrical connector that may be used with an automobile wiring system. Additionally, a need exists for a more cost-efficient and serviceable electrical connector.

BRIEF SUMMARY OF THE INVENTION

In accordance with an embodiment of the present invention, an electrical connector system has been developed that may be used with an automobile power control module. The electrical connector system includes a plurality of sealed plug assemblies. Each sealed plug assembly electrically connects a plurality of electrical contacts with a corresponding number of electrical wires.

Each plug assembly includes a connection housing having a cam lever, which is slidably positioned on the connection housing. Each plug assembly also includes a contact passage cavity, a wire interface cavity, at least one keying feature; and at least one pre-install engagement member.

The electrical connector system also includes a header assembly mounted on a printed circuit board. The header assembly includes a plurality of shrouds for receiving the plurality of sealed plug assemblies. The plurality of shrouds correspond to the plurality of sealed plug assemblies. That is, the number of shrouds equals the numbers of sealed plug assemblies such that one plug assembly is mated with one shroud. Each shroud includes a pre-install member and at least one plug engagement guide. The pre-install member and the pre-install engagement member(s) cooperate to hold each of plug assembly in a first position. The keying feature(s) slidably engage the plug engagement(s) guide if the keying feature is compatible with the plug engagement guide(s). The plug assemblies are fully mated into the sealed plug assemblies through a movement of the cam lever.

Figure 1:
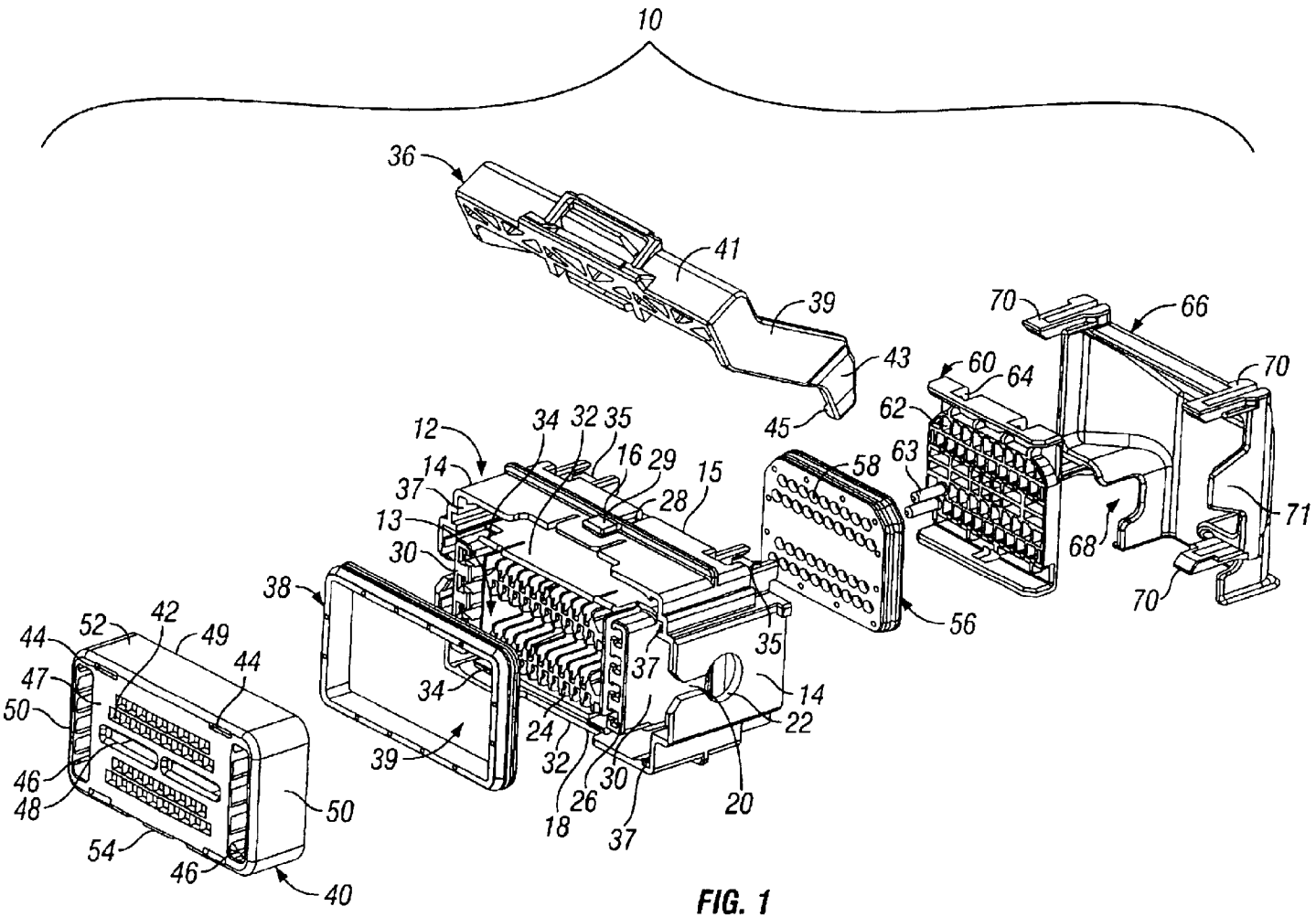
FIG. 1 is an isometric exploded view of a first plug assembly formed in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 is an isometric exploded view of a plug assembly 10 formed in accordance with an embodiment of the present invention. By way of example only, the plug assembly 10 may be a "46 way" plug assembly. That is, the plug assembly 10 may connect up to 46 electrical contacts with a corresponding number of electrical wires. The plug assembly 10 includes a connection housing 12, a cam lever 36, a perimeter seal 38, a spacer 40, a sealing grommet 56, and a wire cover 60 and a wire routing guide shield 66.

The connection housing 12 includes sidewalls 14, a top wall 16, and bottom wall 18 defining both a contact passage cavity 13 on a first side of the connection housing 12 and a wire interface cavity 15 (view of wire interface cavity blocked) on the opposite side of the housing 12. Keying features 37, which ensure proper positioning of the plug assembly 10 into a compatible shroud (as discussed below), are located at the comers of the connection housing 12 (i.e., where the top wall 16 connects to the sidewalls 14 and where the bottom wall 18 connects to the sidewalls 14) on the contact passage cavity 13 side of the plug assembly 10. The contact passage cavity 13 and the wire interface cavity 15 are separated by an interface portion (not shown). The top wall 16 includes a protruding member 29 (forming a pocket underneath) and a latch receptacle 28 formed within the top wall 16. Each sidewall 14 includes a cam channel 20 extending from one edge of the side wall to a circular cam rotation portion 22. The diameter of the circular cam rotation portion 22 is greater than the width of the cam channel 20. The connection housing 12 also includes a plurality of first contact receptacles 24 and a plurality of second contact receptacles 26 formed within the contact passage cavity 13. Additionally, the connection housing 12 includes seal retaining side walls 30 and cover retaining walls 32. Each seal retaining side wall 30 is formed on the exterior of a set of second contact receptacles 26, while one cover retaining wall 32 is formed above the plurality of first contact receptacles 24 and the other cover retaining wall 32 is formed below the plurality of first contact receptacles 24. Additionally, each cover retaining wall 32 includes spacer retaining clips 34. The connection housing 12 also includes latch receptacles 35 extending outwardly and above the wire interface cavity 15.

The cam lever 36 includes arms 39 connected by a bridge section 41. Each arm 39 includes a pivotal element 43 having a shroud engagement member 45 located at a distal end of the pivotal element 43, and a rotation element (not shown) that is formed to rotate through the cam rotation portion 22. The cam lever 36 is described in more detail in U.S. Pat. No. 6,099,330 entitled "Connector With Lever," which issued to Gundermann et al., the entire subject matter of which is hereby incorporated by reference in its entirety.

The perimeter seal 38 includes an inner cavity 39. That is, the perimeter seal 38 is a ring-like member, which defines the inner cavity 39. The perimeter seal 38 is formed to fit over seal retaining sidewalls 30 and to fit between each cover retaining wall 32 and the plurality of first contact receptacles 24.

The spacer 40 includes side walls 50, a top wall 52, a bottom wall 54, and a header interface wall 47 that define an inner cavity 49 (view of inner cavity 49 blocked). The header interface wall 47 includes a plurality of first contact passages 42, clip notches 44, a plurality of second contact passages 46 and anti-scoop receptacles 48. The inner cavity 49 is formed such that the spacer 40 fits around the cover retaining walls 32 of the connection housing 12 and the perimeter seal 38.

The sealing grommet 56 includes a plurality of wire passages 58. The sealing grommet 56 is formed to fit within the wire interface cavity 15 of the housing 12. During assembly, the sealing grommet 56 is positioned between the connection housing 12 and the wire cover 60. The wire cover 60 includes wire passages 62 and latch receptacles 64. Additionally, stops 63 may be inserted into the wire passages 62 if a wire does not pass through a particular wire passage 62. The stops 63 ensure that moisture does not pass into the connection housing 12 through empty wire passages 62. During assembly, the wire cover is positioned between the sealing grommet 56 and the wire routing guard shield 66. The wire routing guard shield 66 includes wire channel 68, housing engaging latch members 70 and a polarized mounting feature 71.

In order to assemble the first plug assembly 10, the cam lever 36 is positioned onto the connection housing 12 such that the rotation elements (not shown) are positioned within the cam rotation portions 22. That is, the rotation elements are slid into the cam rotation portions 22 via the channels 20. The cam lever 36, however, does not necessarily have to be positioned onto the connection housing 12 before the other parts of the first plug assembly 10 are fastened into place.

As mentioned above, the perimeter seal 38 is positioned around the seal retaining sidewalls 30 and under and beneath an associated cover retaining wall 32. That is, the perimeter seal 38 is positioned over the bottom cover retaining wall 32 and beneath the top cover retaining wall 32. When the first plug assembly 10 is fully assembled, the perimeter seal 38 ensures that moisture does not come into contact with the electrical pins, contacts, or elements retained within the connection housing 12 and the spacer 40. After the perimeter seal 38 is in place, the spacer 40 is positioned onto the housing 12.

The spacer 40 is mounted to the connection housing 12 such that the sidewalls 50, the top wall 52 and the bottom wall 54 are positioned around the cover retaining walls 32 and the perimeter seal 38. The spacer 40 snapably engages the housing 12, thereby sandwiching the perimeter seal 38 therebetween, by way of the clip notches 44 engaging and snapably retaining the cover retaining clips 34 formed on the cover retaining walls 32 of the housing 12. Because the spacer 40 and the connection housing 12 act to sandwich the perimeter seal 38 therebetween, a moisture-proof barrier is formed within the contact passage cavity 13 of the connection-housing 12 and the inner cavity 49 of the spacer 40. Thus, electrical pins, contacts or elements positioned and retained within the contact passage cavity 13 and the inner cavity 49 are protected from moisture and other substances that may hinder electrical conductivity. Alternatively, the perimeter seal 38 may be formed to fit over the perimeter of the spacer 40.

The sealing grommet 56 is positioned within a corresponding retaining structure (not shown) within the wire interface cavity 15 of the housing 12. Electrical wires (not shown) pass through the wire passages 58 of the sealing grommet 56. The wire cover 60 is positioned over the sealing grommet 56 thereby sandwiching the sealing grommet 58 between the connection housing 12 and the wire cover 60. The wire cover 60 snapably engages the connection housing 12 through the snapable engagement and retention of latch members by the latch receptacles 64. The wire cover 60 is positioned over the sealing grommet 56 such that the wire passages 58 of the sealing grommet 58 coincide with the wire passages 62 of the wire cover 60. Thus, electrical wires may pass through the wire cover 60 and the sealing grommet 56 into the housing 12. Because the wire cover 60 and the connection housing 12 act to sandwich the sealing grommet 56 therebetween, a moisture-proof barrier is formed within the wire interface cavity 15 of the housing 12. If a smaller number of wires are used than the number of wire passages 58 and 62, stops 63 may be positioned within the wire passages 62 of the wire cover 60 and may or may not extend into the wire passage 58 of the sealing grommet 56.

Once the wire cover 60 is positioned, the wire routing guide shield 66 is positioned over the wire cover 60. The wire routing guide shield 66 mounts to the connection housing 12 by way of the latch members 70 snapably engaging and being retained by the latch receptacles 35 of the housing 12. The wire channel 68 provides a path for electrical wires into the plug assembly 10. A bundled set of wires pass through the wire channel 68. The bundled set of wires are individually separated and routed within the plug assembly 10 such that individual wires may be positioned in, and pass through, the wire passages 58 and 62 in order to pass into the housing 12. Once in the housing, the wires may interface with electrical pins, contacts, or other elements that are positioned within and retained by the contact passages 42, 46 and contact receptacles 24 and 26. The perimeter seal 38 and the sealing grommet 56 help to ensure that no moisture infiltrates the plug assembly 10.

Figure 6:
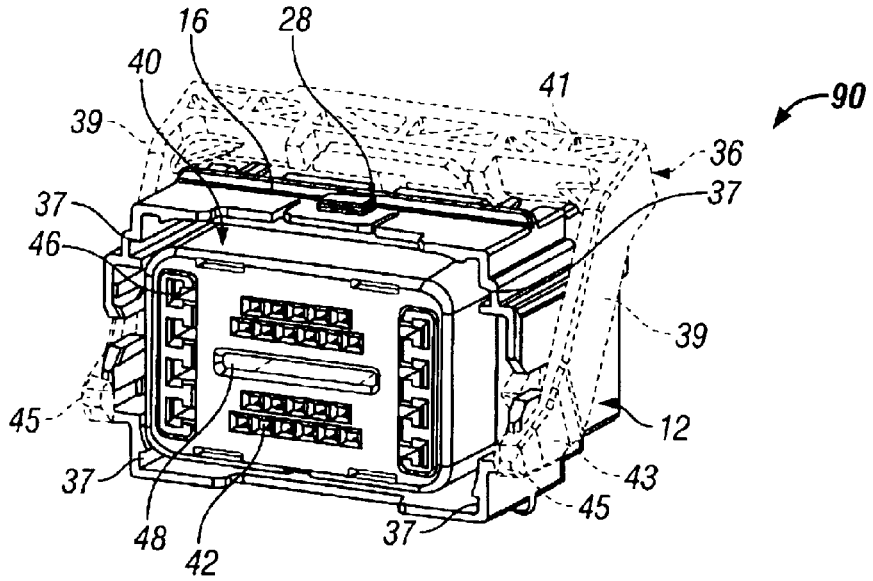
FIG. 6 is an isometric view of a second plug assembly from a header interface side according to an embodiment of the present invention.
Figure 7:
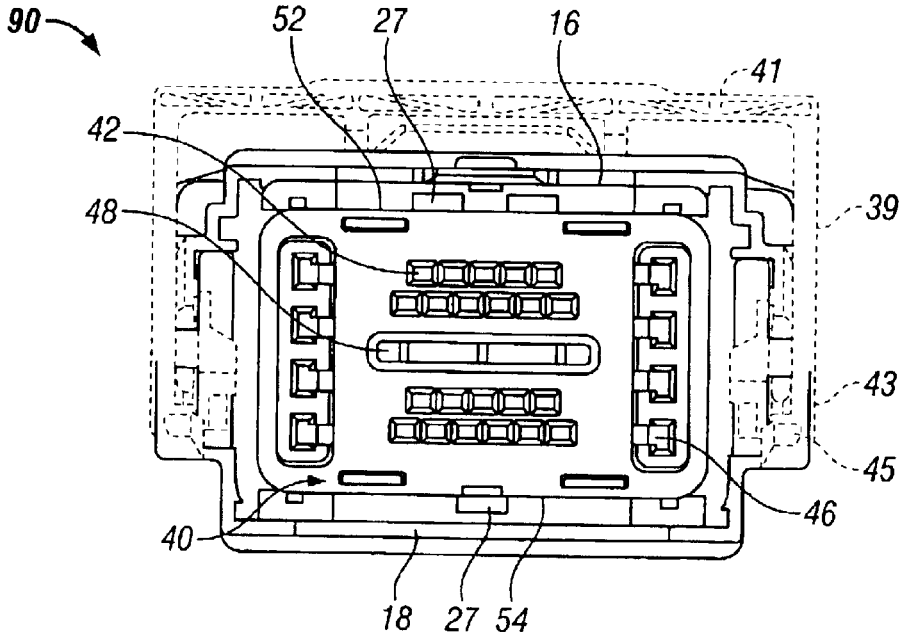
FIG. 7 is a front view of a second plug assembly formed in accordance with an embodiment of the present invention.

As mentioned above, the plug assembly 10 may connect up to 46 different electrical contacts or pins (not shown) with corresponding electrical wires (a "46 way" plug assembly). That is, while the connection housing 10 accommodates a certain amount of contacts, the principles discussed above and below apply to a connection housing that accommodates more or less contacts or pins. For example, while FIGS. 6 and 7 show a plug assembly 90 that connects 30 electrical contacts with 30 corresponding electrical wires (a "30 way" plug assembly), the structures and assembly methods similar to those described above with respect to FIG. 1 are applicable with respect to the plug assembly 90.

Figure 2:
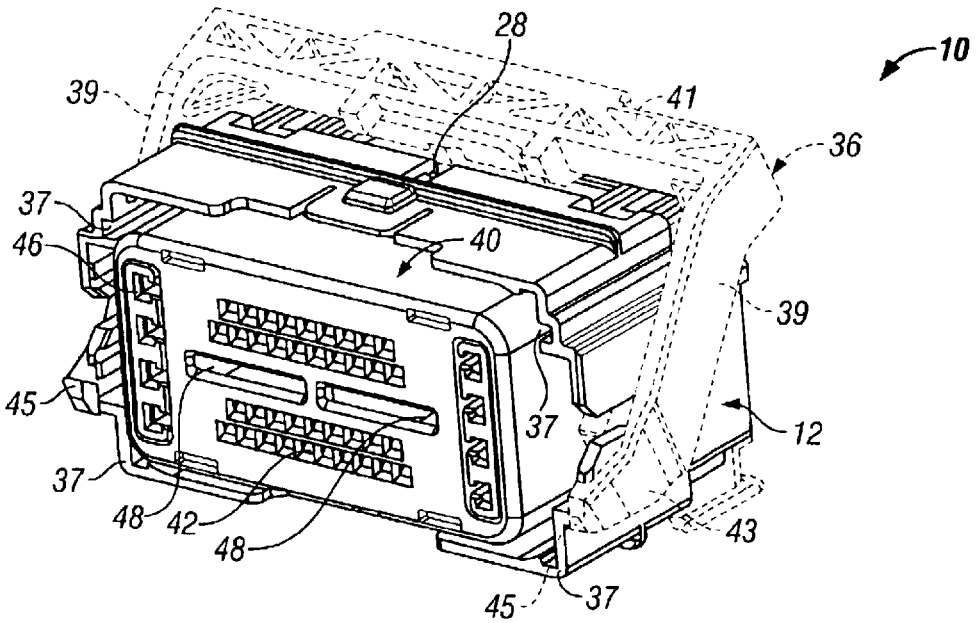
FIG. 2 is an isometric view of a first plug assembly from a header interface side according to an embodiment of the present invention.
Figure 3:
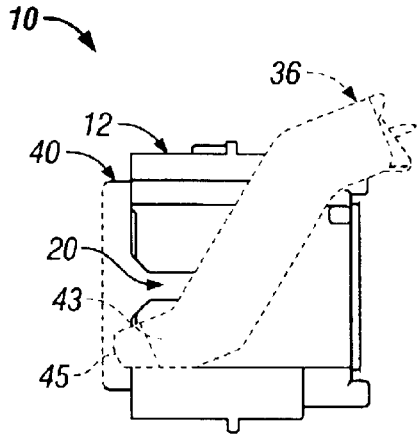
FIG. 3 is a lateral view of a first plug assembly formed in accordance with an embodiment of the present invention.
Figure 4:
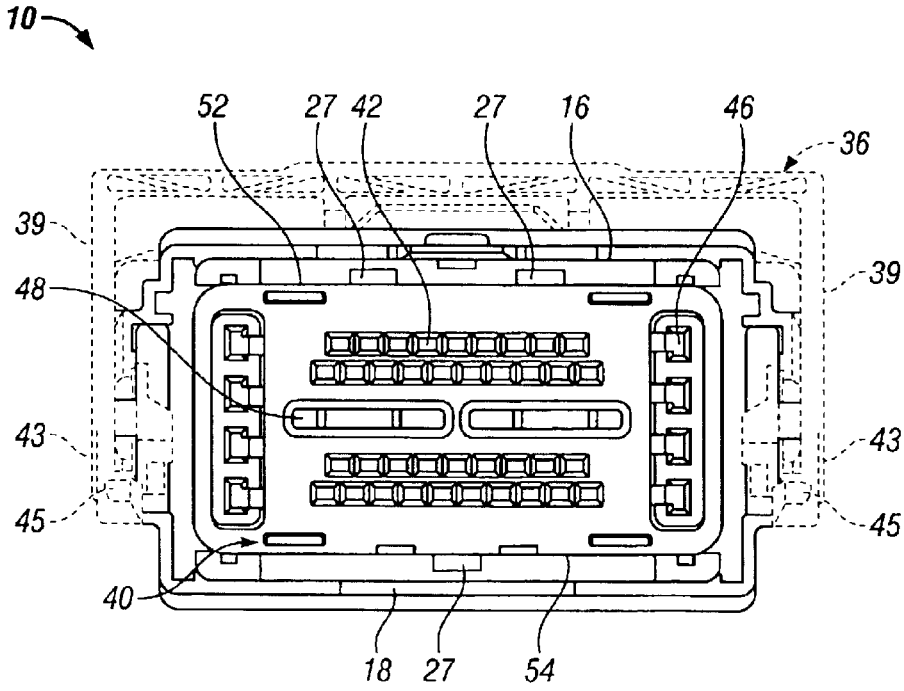
FIG. 4 is a front view of a first plug assembly formed in accordance with an embodiment of the present invention.

FIG. 2 is an isometric view of the plug assembly 10 from a header interface side according to an embodiment of the present invention. FIG. 3 is a lateral view of the plug assembly 10 formed in accordance with an embodiment of the present invention. FIG. 4 is a front view of the plug assembly 10 formed in accordance with an embodiment of the present invention. FIGS. 2–4 show the plug assembly 10 without the wire routing guide shield 66 attached. Alternatively, the plug assembly 10 may or may not include the wire guide shield 10.

As shown in FIG. 4, the plug assembly 10 includes retaining tabs 27 formed within the connection housing 12. The retaining tabs 27 outwardly extend from the cover retaining walls 32. The retaining tabs 27 are formed to engage plug retaining members 138 (discussed below) formed on a shroud, which mates with the plug assembly 10.

Figure 5:
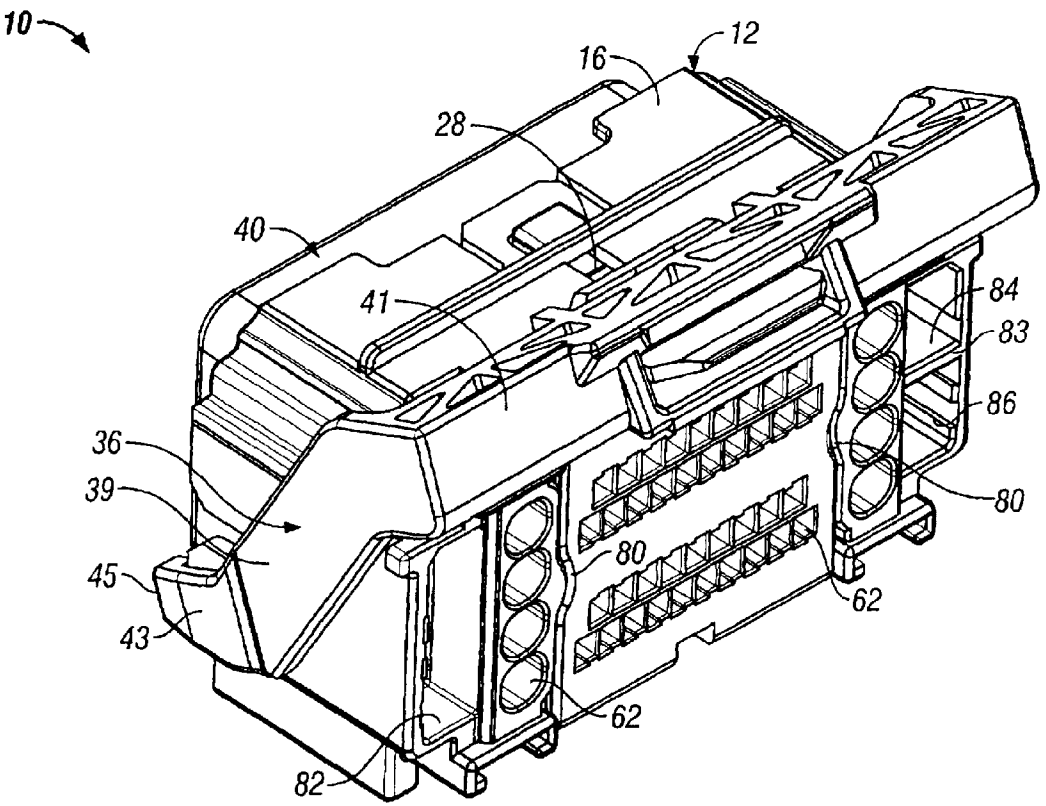
FIG. 5 is an isometric view of a first plug assembly from a wire interface side according to an embodiment of the present invention.
Figure 13:
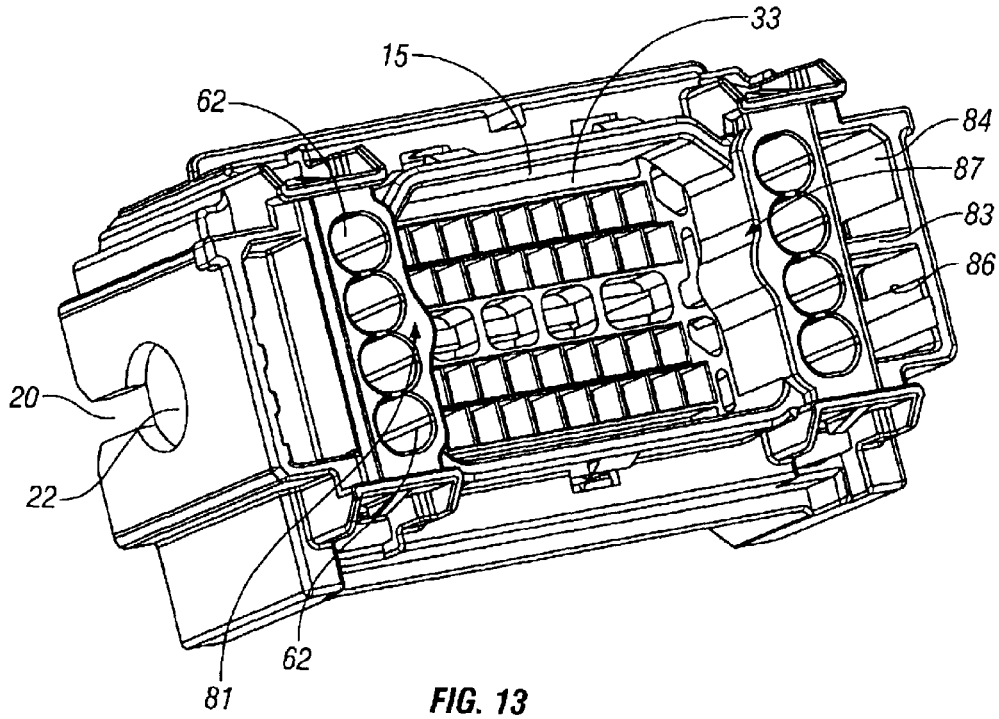
FIG. 13 is an isometric view of a connection housing from a wire interface side according to an embodiment of the present invention.
Figure 14:
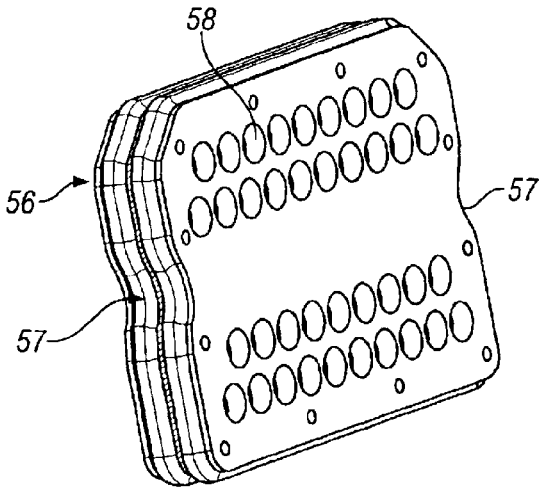
FIG. 14 is an isometric view of a sealing grommet according to an embodiment of the present invention.

FIG. 5 is an isometric view of the plug assembly 10 from a wire interface side according to an embodiment of the present invention. FIG. 13 is an isometric view of a connection housing 12 from a wire interface side according to an embodiment of the present invention. FIG. 14 is an isometric view of a sealing grommet 56 according to an embodiment of the present invention.

Referring to FIGS. 5 and 13, the wire cover 60 includes anti-shift features 80. The connection housing 12 includes grommet cavity 33 (which the sealing grommet 56 is retained within), anti-shift features 81 and orientation features 82, 84, 86 and rib 83. The anti-shift features 80 and 81 ensure that the wire routing guide shield 66 does not shift vertically when fastened to the plug assembly 10. Additionally, referring to FIG. 14, the sealing grommet 56 also includes anti-shift features 57. The wire routing ground shield 66 has compatible features that interact with the anti-shift features 80, 81 and 57 in conjunction with orientation features 82, 84, 86 and rib 83. That is, the wire routing guide shield 66 includes the polarized mounting feature 71 and/or additional retention features that interact with an orientation feature 84 or 86, rib 83 and/or anti-shift features 80 such that the wire routing guide shield 66 is fixed into position when fastened to the plug assembly 10. The orientation features 82, 84 and 86, rib 83 and anti-shift features 80 ensure that the wire routing guide shield 66 is positioned in the proper orientation. The anti-shift features 80, 81 and 57 correspond with each other to allow for proper mating between the connection housing 12, sealing grommet 56 and the wire cover 60. Optionally, the plug assembly 10 may not include the anti-shift features 80, 81 and 57, the orientation features 82, 84, 86, nor the rib 83.

FIG. 6 is an isometric view of a second plug assembly 90 from a header interface side according to an embodiment of the present invention. FIG. 7 is a front view of the plug assembly 90 formed in accordance with an embodiment of the present invention. Structures of the plug assembly 90 that are similar to those found on the plug assembly 10 are denoted with the same reference numerals. For example, both the plug assembly 10 and plug assembly 90 include keying features 37. While both include keying features 37, it should be noted that due to the size differences between the plug assemblies 10 and 90, the keying features 37 of the plug assembly 10 prohibit the mating of the plug assembly 10 into a "30 way" shroud 112, as described below. Similarly, the keying features 37 formed on the plug assembly 90 prohibit the mating of the plug assembly 90 into a "46 way" shroud 110.

The plug assembly 90 differs from the plug assembly 10 in that the plug assembly 90 is smaller than the plug assembly 10 and has less passages for pins and wires. That is, FIGS. 1–5 show, by way of example, a "46 way" plug assembly, while FIGS. 6–7 show, by way of example, a "30 way" plug assembly. Similar to the "46 way" plug assembly 10, the "30 way" plug assembly 90 may connect less than 30 electrical pins to less than 30 electrical wires. That is, stops, similar to stops 63 may be used within the plug assembly 90. Additionally, the invention is by no means limited to "46 way" and "30 way" plug assemblies. Rather, plug assemblies and counterpart shrouds capable of housing and connecting more or less contacts and electrical wires may be utilized, depending on the desired amount of connections within the plug assemblies.

Figure 8:
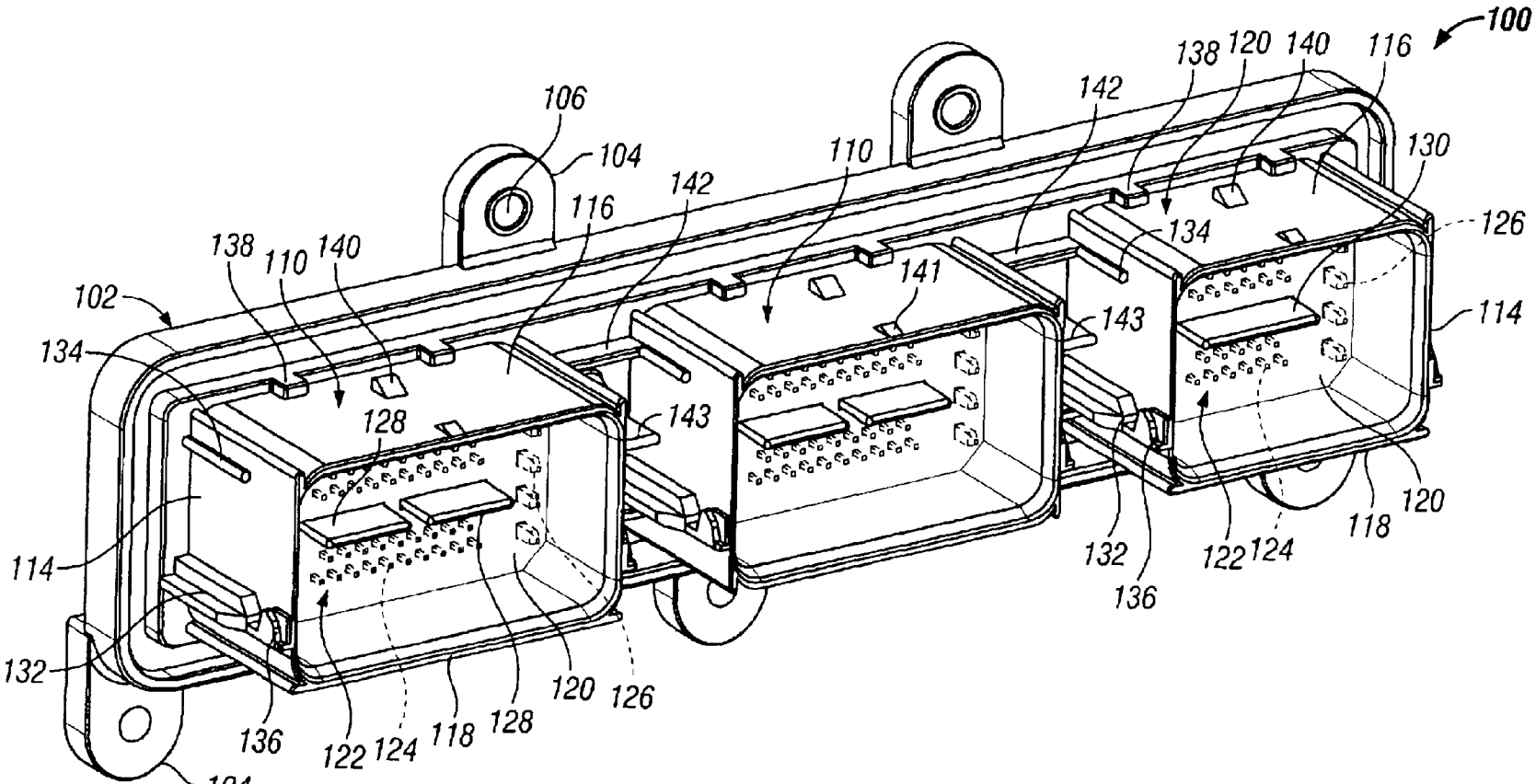
FIG. 8 is an isometric view of a header assembly from a plug interface side according to an embodiment of the present invention.
Figure 9:
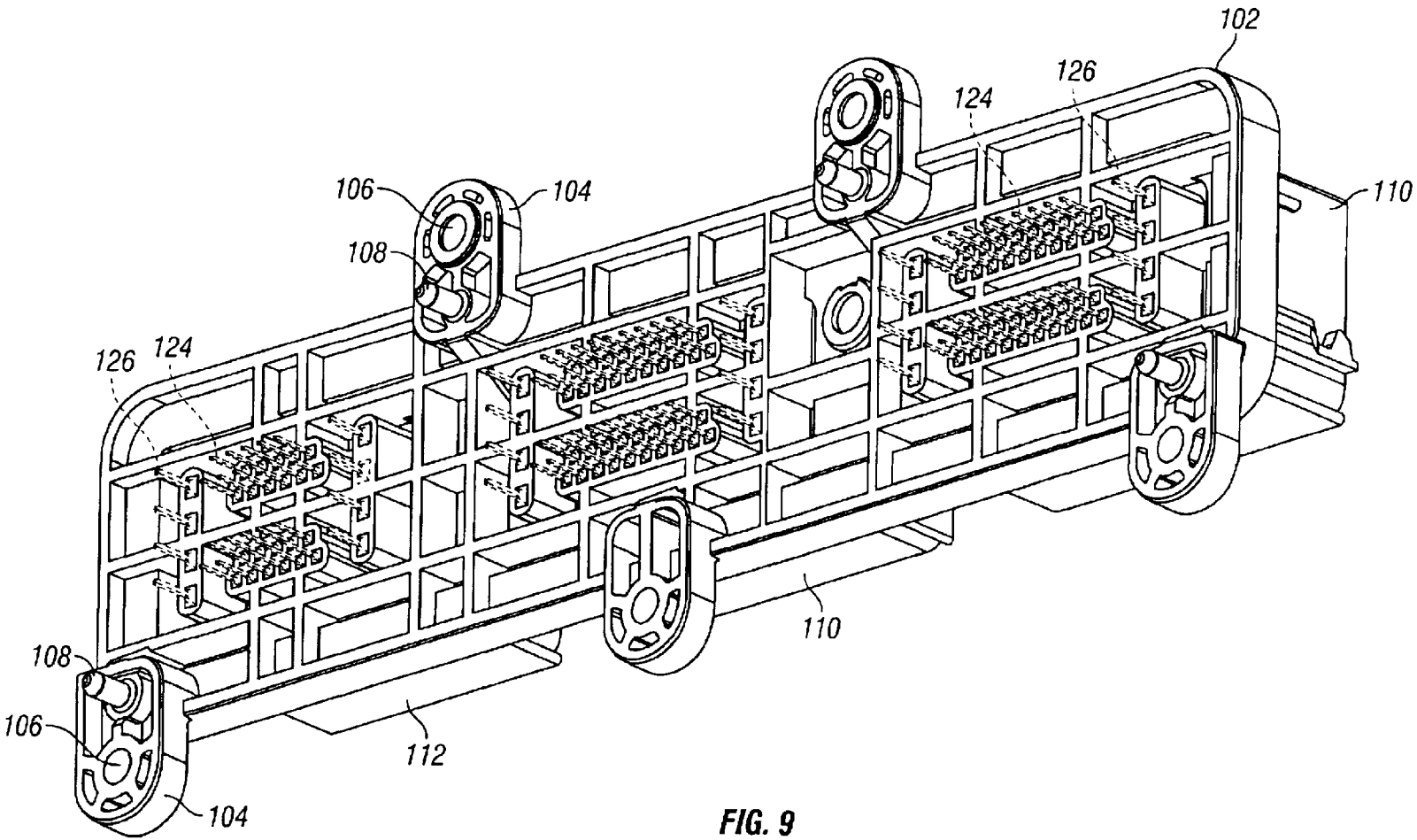
FIG. 9 is an isometric view of a header assembly from a circuit board interface side according to an embodiment of the present invention.

FIG. 8 is an isometric view of a header assembly 100 from a plug interface side according to an embodiment of the present invention. FIG. 9 is an isometric view of the header assembly 100 from a circuit board interface side according to an embodiment of the present invention. The header assembly 100 includes a frame 102 having fastener engagement members 104 extending outwardly from a perimeter of the frame 102, and "46 way" shrouds 110 and a "30 way" shroud 112. The fastener engagement members 104 include fastener through-holes 106 and location pins 108, which extend outwardly on the circuit board interface side. Each shroud 110 and 112 includes side walls 114, a top wall 116, a bottom wall 118 and a frame wall 120 that define a plug cavity 122. A plurality of first electrical contacts 124, second electrical contacts 126 and anti-scoop members 128 (in the "46 way" shroud 110) or anti-scoop member 130 (in the "30 way" shroud 112) extend outwardly from the frame wall 120 inside the plug cavity 122. As shown in FIGS. 8 and 9, the electrical contacts 124 and 126 extend through contact passages (not shown) in the frame such that one terminal end of each contact 124 and 126 is exposed on the plug interface side, while the opposite terminal end of each contact 124 and 126 is exposed on the circuit board interface side. Additionally, each side wall 114 includes plug engagement guides 132 and 134 and cam lever engagement members 136 extending along portions of the side wall 114. The top wall 116 also includes plug retaining members 138 abutting (and or integrally formed with) the frame 102 and extending upwardly from the top wall 116, a triangular ramped member 141 (which engages a retaining feature (not shown) formed within the housing 12), and a ramped pre-install retaining member 140. Supporting ribs 142 and 143 are positioned between each shroud 110 and 112 to prevent warping and other undesirable effects caused by stresses and strains within the header assembly 100. The distance between rib 142 and 143 substantially coincides with the width of the cam channel 20, such that the cam channel 20 is positioned over the ribs 142 and 143. Thus, the height of each rib 142 and 143 may be substantially the same as the height of the cam channel 20, thereby providing additional overall support when the header assembly 100 and the plug assembly 10 are mated.

The header assembly 100 is mounted to a printed circuit board (not shown) having a plurality of contact receptacles, which correspond to the number of electrical contacts 124 and 126 positioned within the header assembly 100. The electrical contacts 124 and 126 are typically soldered to the printed circuit board. The location pins 108 are retained by location contact receptacles on the printed circuit board, and fasteners, such as screws, are positioned within the fastener through-holes 106 and are used to fasten the header assembly to the printed circuit board.

The anti-scoop members 128 of the "46 way" shroud 110 receive and retain the anti-scoop receptacles 48 of the "46 way" plug assembly 10, while the anti-scoop member 130 of the "30 way" shroud 112 receives and retains the anti-scoop receptacle 48 of the "30 way" plug assembly 90. Thus, while the overall sizes of the plug assembly 10 and plug assembly 90 ensure that each plug assembly 10 and 90 is mated with a compatible shroud, the "30 way" plug assembly 90 may not be mated with a "46 way" shroud 110 due also, in part, to the different anti-scoop configuration (in conjunction with the keying features 37, as discussed below) between the "30 way" plug assembly and the "46 way" shroud 110. Similarly, the "46 way" plug assembly 10 may not be mated with a "30 way" shroud 112. That is, the anti-scoop receptacle 48 of a "30 way" plug assembly 90 does not accept the anti-scoop members 128 of the "46 way" shroud 110, nor do the anti-scoop receptacles 48 of the "46 way" plug assembly 10 accept the anti-scoop member 130 of the "30 way" shroud 112.

Figure 10:
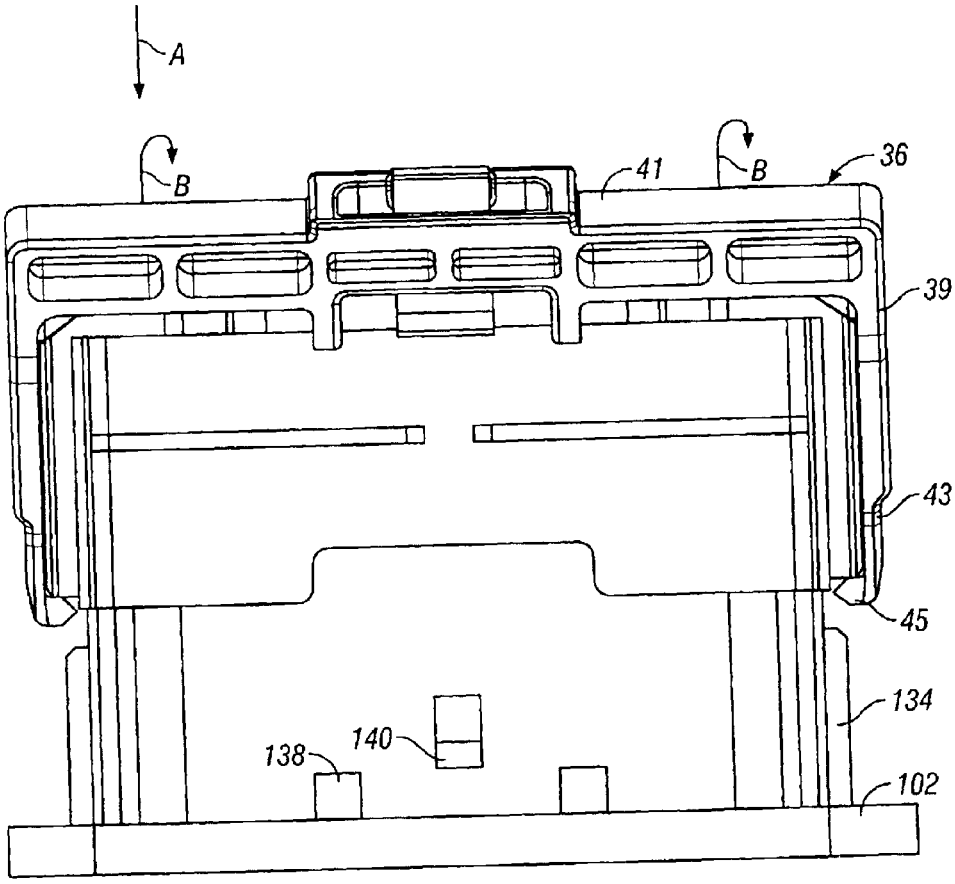
FIG. 10 is a top view of a plug assembly and the header assembly in a pre-mated position, according to an embodiment of the present invention.

FIG. 10 is a top view of a plug assembly 10 or 90 and the header assembly 100 in a pre-mated position, according to an embodiment of the present invention. The mating of a plug assembly with a header shroud through cam lever actuation is described in U.S. Pat. 6,099,330, which, as mentioned above, is incorporated by reference herein in its entirety.

While the following discussion refers to the plug assembly 10 and the "46 way" shroud 110, the same principles apply to the plug assembly 90 and the "30 way" shroud 112. In order to mate the plug assembly 10 with the shroud 110, the plug assembly 10 is moved towards the shroud in the direction denoted by reference line A. The plug assembly 10 slidably engages the shroud 110 such that the top wall 116, bottom wall 118 and side walls 114 of the shroud 110 slide over the top wall 52, bottom wall 54 and side walls 50 of the spacer 40, respectively. As the plug assembly 10 continues to move towards the frame 102 of the shroud 110, the top wall 16, bottom wall 18 and side walls 14 of the connection housing 12 slide over the top wall 116, bottom wall 118 and sidewalls 114 of the shroud 110. Thus, the shroud 110 is positioned between the spacer 40 and the exterior walls 116, 118 and 114 of the housing.

The keying features 37 of the housing 12, in conjunction with the mating (or lack thereof in the case of incompatible components) of the anti-scoop members 128 with the anti-scoop receptacles 48, ensure. that the plug assembly 10 is not mated into a "30 way" shroud 112. That is, keying features 37 slidably engage the plug engagement guides 132 and 134 located on the sides of the shroud 110. Because the keying features 37 of the plug assembly 10 are sized differently than those of the plug assembly 90, the plug engagement guides 132 and 134 do not cooperate with, or otherwise accept, the keying features 37 of the plug assembly 90. Thus, the keying features 37 of the plug assembly 10 and corresponding plug engagement guides 132 and 134 of the shroud 110 prohibit the plug assembly 90 from mating with the "46 way" shroud 110. Similarly, the keying features 37 of the plug assembly 90 and corresponding plug engagement guides 132 and 134 of the shroud 112 prohibit the plug assembly 10 from mating with the "30 way" shroud 112.

As the plug assembly 10 continues to slidably engage the shroud 110 in the direction of reference line A, the cam lever 36 is deflected by at least one of the plug engagement guides 132, 134 and the cam lever engagement members 136 such that the cam lever 36 pivots on, or rotates through, the cam rotation portion 22. The cam lever engagement members 136 also include features that position the cam lever 36 in a first position during a pre-lock, or pre-install, position and lock the cam lever 36 into position upon full mating. Alternatively, the cam lever engagement members 136 may not include additional features to orient the cam lever 36 during different mating stages. As the cam lever 36 is further deflected by the cam lever engagement members 136 and/or the plug engagement guides 132 and 134, the cam lever 36 swings over the top wall 16 of the connection housing 12 and the top wall 116 of the shroud 110 (in the direction of reference line B) until the plug assembly 10 encounters the pre-install, or pre-lock member 140.

The pre-lock member 140 engages an engagement feature, such as the pocket formed underneath the protruding member 29 and/or the latching receptacle 28, formed under, or through, the top wall 16 of the housing 12. For example, the ramped surface of the pre-lock member 140 may permit a wall bounding the pocket underneath the protruding member 29 to slide over the pre-lock member 140. The ramped surface of the pre-lock member 140 terminates at an edge, which may then catch, snag, or otherwise abut a wall of the pocket formed underneath the protruding member 29. Optionally, the pre-lock member 140 may latch to the latching receptacle 28 in order to hold the plug assembly 10 in a pre-lock position. Also, optionally, the pre-lock member 140 may first engage the protruding member 29 and then the latching receptacle 28. Thus, the plug assembly 10 may be held in place by the latching, or catching, of the pre-lock member 140 with the protruding member 29 and/or the latching receptacle 28 formed in the top wall 16 of the connection housing 12 during the pre-lock stage of mating. Because the plug assembly 10 is held in place by the latching of the pre-lock member 140 and the protruding member 29 and/or the pre-lock latching receptacle 28, the person installing the plug assembly 10 onto the shroud 110 may free a hand to operate the cam lever 36 in order to actuate the plug assembly 10 into a fully mated position with the shroud 110.

As the movement of the cam lever 36 in the direction of reference line B continues to actuate the plug assembly 10 toward the shroud 110 into a fully mated position, the positioning tabs 27 formed on the connection housing 12 receive and retain the plug retaining members 138 formed on the shroud 110. When the positioning tabs 27 are completely retained by the retaining members 138, the plug assembly 10 and the shroud are fully mated.

Figure 11:
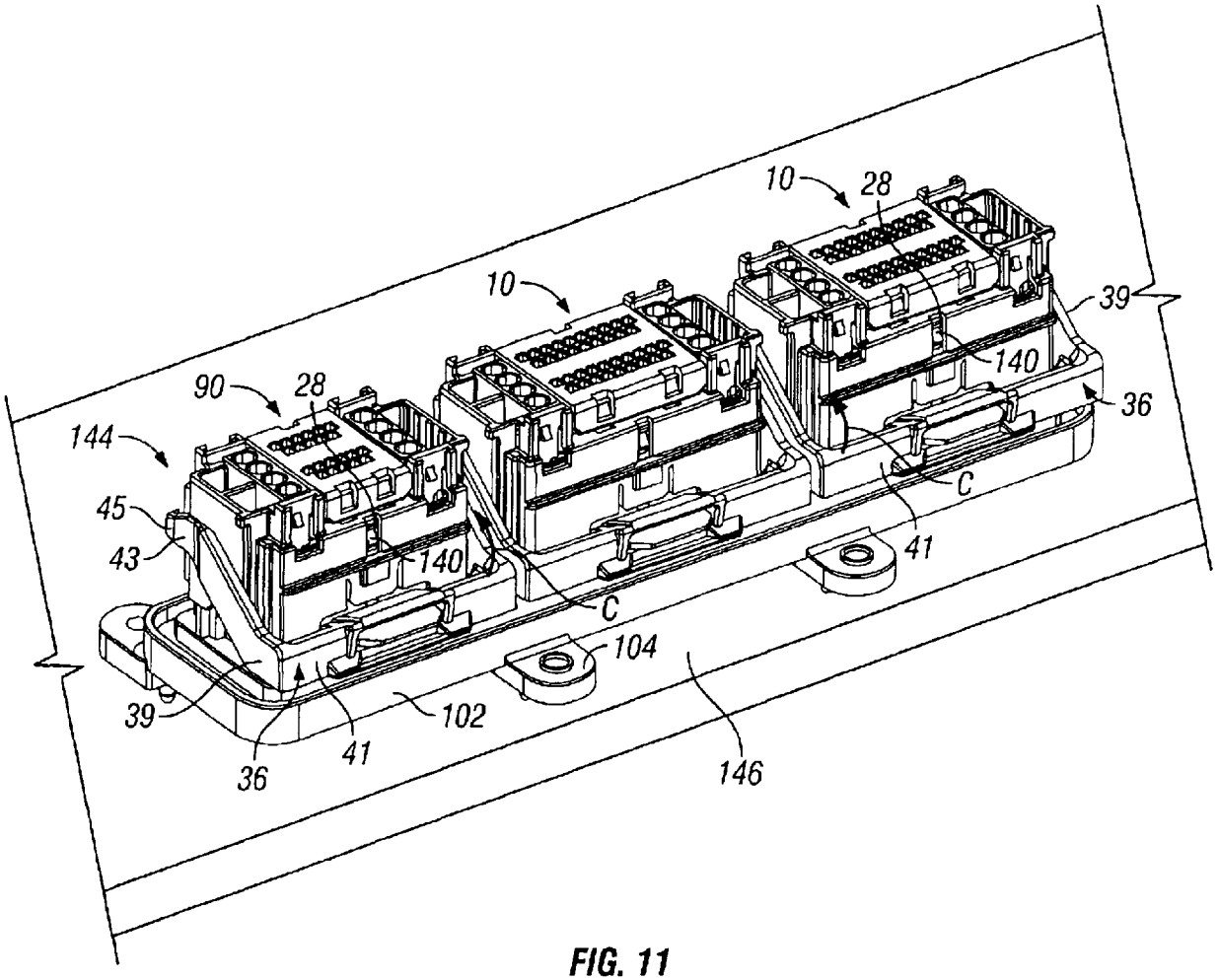
FIG. 11 is an isometric view of an electrical connector formed in accordance with an embodiment of the present invention.

FIG. 11 is an isometric view of an electrical connector 144 formed in accordance with an embodiment of the present invention. As shown in FIG. 11, the electrical connector is mounted on a printed circuit board 146. Additionally, the electrical connector 144 is a "122 way" electrical connector. That is, two plug assemblies 10 (i.e., the "46 way" plug assemblies) and one plug assembly 90 (i.e., the "30 way" plug assembly) are mounted onto the header assembly 100. Thus, 122 electrical connections may be made between the printed circuit board 146, such as a printed circuit board for a power train control module of an automobile, and a system, such as a power train of an automobile. Additionally, because a plurality of electrical contacts are housed in a plurality of plug assemblies 10 and 90, if a faulty connection is present, the entire electrical connector assembly 144 does not have to be replaced. That is, instead of changing an all-encompassing plug assembly housing all the electrical connections, only the plug assembly 10 or 90 with the faulty connection needs to be replaced. Also, the mating of a plurality of plug assemblies 10 and 90 into a corresponding set of shrouds 110 and 112 allows for quick servicing and interchangeability between plug assemblies 10 and 90 with corresponding shrouds 110 and 112, respectively. That is, if one knows that a faulty connection, or damaged contacts, etc. are in a first plug assembly, one only needs to change that plug assembly (and leave the remaining plug assemblies in tact).

Figure 12:
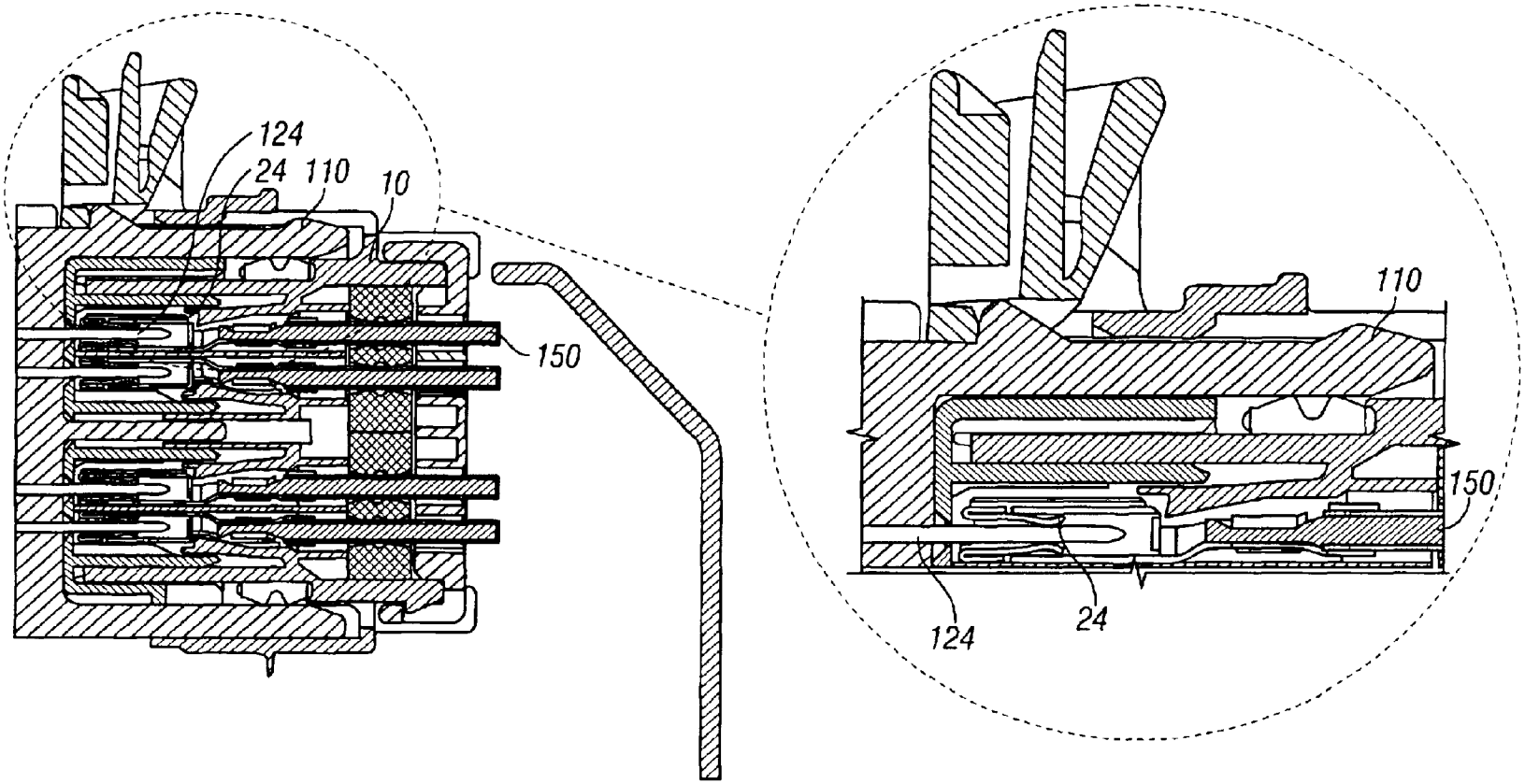
FIG. 12 is a side cross-sectional view of electrical contacts interfacing with electrical wires, according to an embodiment of the present invention.

FIG. 12 is a side cross-sectional view of first electrical contacts 124 interfacing with electrical wires 150, according to an embodiment of the present invention. FIG. 14 applies equally to plug assembly 10 and plug assembly 90. Each electrical contact 124 makes electrical contact with an electrical wire 150 through a first contact receptacle 24. The second electrical contacts 126 may interface with electrical wires 150 in a similar fashion. Alternatively, the first and second electrical contacts 124 and 126 may electrically connect with electrical wires 150 in various other ways, which are known in the art. Also, alternatively, additional types of electrical contacts may be used within the electrical connector 144. That is, embodiments of the present invention are not limited to only two different types of electrical contacts. Further, embodiments of the present invention may utilize only one type of electrical contact.

Referring again to FIG. 11, in order to disengage the plug assembly 10 from the shroud 110, the cam lever 36 is pulled-up from the shroud 110 in the direction of reference line C. As the cam lever 36 is pulled up, the plug assembly 10 becomes dislodged from the shroud 110. Additionally, as the plug assembly 10 recedes from the shroud, the pre-lock member 140 latches, or otherwise catches, the engagement feature, such as the pocket formed under the protruding member 29 and/or the pre-lock receptacle 28, formed under or through the top wall 16 of the housing 12, thereby holding the plug assembly 10 in place.

While embodiments of the present invention have been shown with "46 way" and "30 way" plug assemblies, the electrical connector 144 may be adapted to accommodate various other types of plug assemblies. For example, the electrical connector 144 may be adapted to accommodate "92 way" and "60 way" plug assemblies. Also, for example, the electrical connector 144 may be adapted to accommodate "23 way" and "15 way" plug assemblies. Also, alternatively, more or less plug assemblies may be mounted on the header assembly 100. For example, the header assembly 100 may be adapted to accommodate 2 plug assemblies or 5 plug assemblies. Also, for example, the header assembly 100 may include 5 shrouds, 3 of which are "30 way" shrouds, while 2 are "46 way" shrouds. Overall, there is a variety of configurations that the electrical connector 144 may embody to accommodate various applications.

Thus, an electrical connector system is provided that is well suited for a high number of electrical contacts and connections. That is, because the total number of contacts are spread out among a plurality of plug assemblies and shrouds, the cam lever actuation is able to provide enough force for the mating of each plug assembly into each shroud (as opposed to having only one plug assembly mated into one shroud such that all the contacts and connections are included within the single plug assembly and single shroud). An electrical connector system is provided that protects electrical connections from moisture, contaminants, etc. A more cost-efficient and serviceable electrical connector is achieved because, if a few electrical contacts or connections are faulty, only the portions of the electrical connector, such as an individual plug assembly, that includes the faulty contact needs to be replaced. Alternatively, if the plug assembly is to be salvaged, one may more efficiently find the faulty contact due to the smaller number of contacts in the one plug assembly out of the plurality of plug assemblies (as opposed to one plug assembly that retains all the contacts). That is, finding one faulty contact out of 30 or 46 is easier than finding one faulty contact out of 122 contacts.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector system for use with an automobile power control module, comprising:

a plurality of plug assemblies, each of said plug assemblies including a cam lever a connection housing having a wire interface cavity, a sealing grommet positioned within said wire interface cavity of said connection housing, and a wire cover compressing said sealing grommet into said connection housing, said sealing grommet forming a moisture-proof seal between said connection housing and said wire cover; and a header assembly including a frame having a plurality of integrally formed shrouds for receiving said plurality of plug assemblies, said plurality of shrouds corresponding to said plurality of plug assemblies, each of said plug assemblies being mated into one of said plurality of shrouds through a movement of said cam lever.

2. The electrical connector system of claim 1 wherein each of said plurality of plug assemblies electrically connects a plurality of electrical contacts with a corresponding number of electrical wires, such that one of said plurality of electrical contacts connects with one of said plurality of electrical wires.

3. The electrical connector system of claim 1 wherein each of said plurality of-plug assemblies includes:

a connection housing having a contact passage cavity;

a perimeter seal positioned about said contact passage cavity; and a spacer mounted over said perimeter seal, said perimeter seal forming a moisture-proof seal between said connection housing and said spacer.

4. The electrical connector system of claim 1 wherein each of said plurality of-plug assemblies includes a wire routing guide shield, said wire routing guide shield including a wire channel that provides an inlet for electrical wires into said plug assembly.

5. The electrical connector system of claim 1 wherein each of said plurality of shrouds includes a pre-install member, and wherein each of said plurality of plug assemblies includes at least one engagement member, said pre-install member and said at least one engagement member cooperating to hold each of said plurality of plug assemblies in a pre-mating position.

6. The electrical connector system of claim 1 wherein each of said plurality of-plug assemblies includes at least one keying feature, and each of said plurality of shrouds including at least one plug engagement guide, said at least one keying feature slidably engaging said at least one plug engagement guide thereby allowing each of said plurality of plug assemblies to be mated with a compatible one of said plurality of shrouds.

7. The electrical connector system of claim 1 wherein said plurality of-plug assemblies include at least one first plug assembly and at least one second plug assembly, said first plug assembly and said second plug assembly configured differently from one another.

8. The electrical connector system of claim 1 wherein said plurality of plug assemblies include one "30 way" plug assembly and two "46 way" plug assemblies, and said plurality of shrouds include one "30 way" shroud and two "46 way" shrouds.

9. The electrical connector system of claim 1 wherein said header assembly further includes anti-warp ribs positioned between said plurality of shrouds, said anti-warp ribs providing additional support between said plurality of shrouds in order to minimize warping in said electrical connector system.

10. The electrical connector system of claim 1 wherein said header assembly is mounted on a printed circuit board.

11. An electrical connector system including:

a plurality of plug assemblies, each of said plurality of plug assemblies including:

a connection housing having a contact passage cavity and a wire interface cavity;

a perimeter seal positioned about said contact passage cavity and a spacer mounted over said perimeter seal, said perimeter seal forming a moisture-proof seal between said connection housing and said spacer;

a cam lever slidably positioned on said connection housing; and a wire routing guide shield, said wire routing guide shield including a wire channel that provides an inlet for electrical wires into said each of said plurality of plug assemblies; and a header assembly including a frame having a plurality of integrally formed shrouds for receiving said plurality of plug assemblies, said plurality of shrouds corresponding to said plurality of plug assemblies, each of said plug assemblies being mated into one of said plurality of shrouds through a movement of said cam lever.

12. The electrical connector system of claim 11 wherein said each of said plug assemblies includes a sealing grommet positioned within said wire interface cavity; and a wire cover compressing said sealing grommet into said connection housing, said sealing grommet forming a moisture-proof seal between said connection housing and said wire cover.

13. The electrical connector system of claim 11 wherein each of said plurality of plug assemblies electrically connects a plurality of electrical contacts with a corresponding number of electrical wires, such that one of said plurality of electrical contacts connects with one of said plurality of electrical wires.

14. The electrical connector system of claim 11 wherein each of said plurality of shrouds includes at least one pre-install member, and wherein each of said plurality of plug assemblies includes at least one engagement member, said at least one pre-install member and said at least one engagement member cooperating to hold each of said plurality of plug assemblies in a pre-mating position.

15. The electrical connector system of claim 11 wherein each of said plurality of plug assemblies includes at least one keying feature, said at least one keying feature allowing each of said plurality of plug assemblies to be mated with a compatible one of said plurality of shrouds.

16. The electrical connector system of claim 11 wherein said plurality of plug assemblies include at least one first plug assembly and at least one second plug assembly, said first plug assembly configured differently from said second plug assembly.

17. The electrical connector system of claim 11 wherein said plurality of plug assemblies include one "30 way" plug assembly and two "46 way" plug assemblies, and said plurality of shrouds include one "30 way" shroud and two "46 way" shrouds.

18. The electrical connector system of claim 11 wherein said header assembly further includes anti-warp ribs positioned between said plurality of shrouds, said anti-warp ribs providing additional support between said plurality of shrouds in order to minimize warping in said electrical connector system.

19. The electrical connector system of claim 11 wherein said header assembly is mounted on a printed circuit board.

20. An electrical connector system for use with an automobile power train control module, said system including:

a plurality of-plug assemblies, each of said plurality of sealed plug assemblies electrically connecting a plurality of electrical contacts with a corresponding number of electrical wires, each of said-plug assemblies including:

a connection housing having a contact passage cavity, a wire interface cavity, at least one keying feature; and at least one pre-install engagement member, a perimeter seal positioned about said contact passage cavity and a spacer mounted over said perimeter seal, said perimeter seal forming a moisture-proof seal between said connection housing and said spacer;

a sealing grommet positioned within said wire interface cavity; and a wire cover compressing said sealing grommet into said connection housing, said sealing grommet forming a moisture-proof seal between said connection housing and said wire cover; and a cam lever slidably positioned on said connection housing; and a header assembly configured to be mounted on a printed circuit board, said header assembly including:

a frame having a plurality of integrally formed shrouds for receiving said plurality of sealed plug assemblies, said plurality of shrouds corresponding to said plurality of sealed plug assemblies, each of said plurality of shrouds including a pre-install member and at least one plug engagement guide, said pre-install member and said at least one pre-install engagement member cooperating to hold each of said plurality of plug assemblies in a first position, said at least one keying feature slidably engaging said at least one plug engagement guide if said at least one keying feature is compatible with said at least one plug engagement guide, and each of said sealed plug assemblies being mated into one of said plurality of shrouds through a movement of said cam lever.

21. The electrical connector system of claims 20 wherein said header assembly includes anti-warp ribs positioned between said plurality of shrouds, said anti-warp ribs providing additional support between said plurality of shrouds in order to minimize warping in said electrical connector system.

22. The electrical connector system of claim 20 wherein each of said plurality of plug assemblies includes a wire routing guide shield, said wire routing guide shield including a wire channel that provides an inlet for electrical wires into said plug assembly.

23. The electrical connector system of claim 20 wherein said plurality of plug assemblies include at least one first plug assembly and at least one second plug assembly, said first plug assembly configured differently from said second plug assembly.

24. The electrical connector system of claim 20 wherein said plurality of plug assemblies include one "30 way" plug assembly and two "46 way" plug assemblies, and said plurality of shrouds include one "30 way" shroud and two "46 way" shrouds.

25. The electrical connector system of claim 20 wherein said header assembly is mounted on a printed circuit board.

* * * * *